US008122894B2

(12) United States Patent
Kilpatrick

(10) Patent No.: US 8,122,894 B2
(45) Date of Patent: Feb. 28, 2012

(54) CIGARETTE AND CIGAR CONTAINER AND DISPOSAL RECEPTACLE

(76) Inventor: Penny K Kilpatrick, Virginia Beach, VA (US)

( * ) Notice: Subject to any disclaimer, the term of this patent is extended or adjusted under 35 U.S.C. 154(b) by 460 days.

(21) Appl. No.: 12/483,516

(22) Filed: Jun. 12, 2009

(65) Prior Publication Data

US 2009/0314299 A1 Dec. 24, 2009

Related U.S. Application Data

(60) Provisional application No. 61/073,469, filed on Jun. 18, 2008.

(51) Int. Cl.
*A24D 1/12* (2006.01)

(52) U.S. Cl. ..... 131/175; 131/187; 131/174

(58) Field of Classification Search ..... 131/187, 131/175, 174, 185; 206/246
See application file for complete search history.

(56) References Cited

U.S. PATENT DOCUMENTS

| | | | | |
|---|---|---|---|---|
| 3,827,444 | A | | 8/1974 | Khan |
| 4,289,149 | A | | 9/1981 | Kyriakou |
| 4,637,407 | A | | 1/1987 | Bonanno et al. |
| 4,685,477 | A | | 8/1987 | Valdez |
| 4,790,332 | A | | 12/1988 | Wallace |
| 4,922,931 | A | | 5/1990 | Nare et al. |
| 4,993,435 | A | | 2/1991 | McCann |
| 5,160,518 | A | | 11/1992 | Vega, Jr. |
| 5,190,061 | A | | 3/1993 | Brackmann et al. |
| 5,226,683 | A | | 7/1993 | Julien et al. |
| 5,495,859 | A | | 3/1996 | Bowen et al. |
| 5,598,853 | A | * | 2/1997 | Hyre ..... 131/175 |
| 5,638,833 | A | | 6/1997 | Bowen et al. |
| D381,115 | S | | 7/1997 | Dicicco |
| 6,006,757 | A | | 12/1999 | Lichtenberg |
| 6,158,530 | A | | 12/2000 | Bowen et al. |
| 6,371,127 | B1 | | 4/2002 | Snaidr et al. |
| 6,748,955 | B2 | | 6/2004 | Snaidr et al. |
| 7,231,924 | B2 | | 6/2007 | Shaw et al. |
| 2005/0016552 | A1 | | 1/2005 | Presnell et al. |
| 2005/0205103 | A1 | | 9/2005 | Luedecke |
| 2006/0027242 | A1 | | 2/2006 | Edwards, Jr. |

* cited by examiner

*Primary Examiner* — Richard Crispino
*Assistant Examiner* — Dionne Walls Mayes
(74) *Attorney, Agent, or Firm* — Benesch, Friedlander, Coplan & Aronoff LLP

(57) ABSTRACT

In one embodiment, a container for storing cigarette or cigar ash has a body, a mouthpiece opening with a connection surface, an end section with an igniting and a closure device, a secure and release device, a grip, and a filter. In another embodiment, a container includes an inner tube, a filter, an outer tube, a stopper and a handle, and connecting ends. In yet another embodiment, a disposal receptacle to store ash has a lid and a lower barrel where the lid includes an opening and a plate that covers the opening or exposes it, and all the components are made of non-flammable material including, but not limited to, non-flammable, hard plastic. In another embodiment, a method is disclosed that shows how a person uses the cigarette or cigar container and the disposal receptacle.

7 Claims, 9 Drawing Sheets

CIGARETTE AND CIGAR CONTAINER AND DISPOSAL RECEPTACLE

FIELD OF INVENTION

The present application is directed to a container and disposal receptacle. More particularly, the present application is directed to a container, an igniter, and a disposal receptacle for various forms of cigarettes, cigars, and the like, and a method of using the same. Further, the present application is directed to a container and disposal receptacle that also functions as a smoke filter.

BACKGROUND

Cigarettes and cigars produce smoke that is known to have deleterious effects on the environment and health of individuals. Some cigarette and cigar holders in the art include filters that reduce the amount of smoke released to the environment.

Cigarettes and cigars also produce ash that must be disposed during and after smoking. Often, a person smoking a cigarette or cigar is not close to a receptacle where the ash can be disposed, so either the person has to make frequent trips to dispose the ashes or the ashes fall to the ground, floor, table or other surfaces around the person smoking. Waste from cigarettes and cigars and accidental fires from unextinguished cigarettes and cigars are tremendous threats to our environment.

SUMMARY

In one embodiment, a container for storing cigarette or cigar ash has a body, a mouthpiece opening with a connection surface, an end section with an igniting and closure device, a secure and release device, a grip, and a filter. In another embodiment, a container includes an inner tube, a filter, an outer tube, a stopper and a handle, and connecting ends.

In yet another embodiment, a disposal receptacle configured to store ash includes a lid and a lower barrel. The lid includes an opening and a plate that covers the opening or exposes it. The components are made of non-flammable material including, but not limited to, non-flammable, hard plastic.

In another embodiment, a method is disclosed for using the cigarette or cigar container and the disposal receptacle in combination.

BRIEF DESCRIPTION OF THE DRAWINGS

In the accompanying drawings which are incorporated in and constitute a part of the specification, embodiments are illustrated which, together with the detailed description given below, serve to describe exemplary embodiments. It will be appreciated that the illustrated boundaries of elements (e.g. boxes, groups of boxes, or other shapes) in the figures represent but exemplary boundaries. One of ordinary skill in the art will appreciate, for example, that one element may be designed as multiple elements or that multiple elements may be designed as one element. An element shown as an internal component of another element may be implemented as an external component and vice versa. The drawings and components therein are not to any scale. Certain components may be omitted and others shown enlarged to facilitate understanding.

DETAILED DESCRIPTION

A container is provided to hold a cigarette, cigar, and the like while a person smokes and to contain the ash that forms from the burning cigarette and the like. Further, a disposal receptacle is provided to dispose the ash and cigarette remains (e.g., the cigarette mouthpiece and filter) after a person is finished smoking. In one embodiment, the container is a device that can hold various forms of cigarettes, including standard size and larger size cigarettes. The container holds one cigarette at a time and can contain ash and the remaining mouthpiece. In one embodiment, the container is configured to connect with a disposal receptacle so the ash and cigarette remains can be transferred to the disposal receptacle. The disposal receptacle may come in various sizes and is configured to be filled with ash and cigarette or cigar remains until full, when the contents of the disposal receptacle can be discarded. In other embodiments, the container is configured to hold cigars and other smoking items of varying diameters and lengths. A method is also provided to show how to combine the container and the disposal receptacle.

Figure 1:
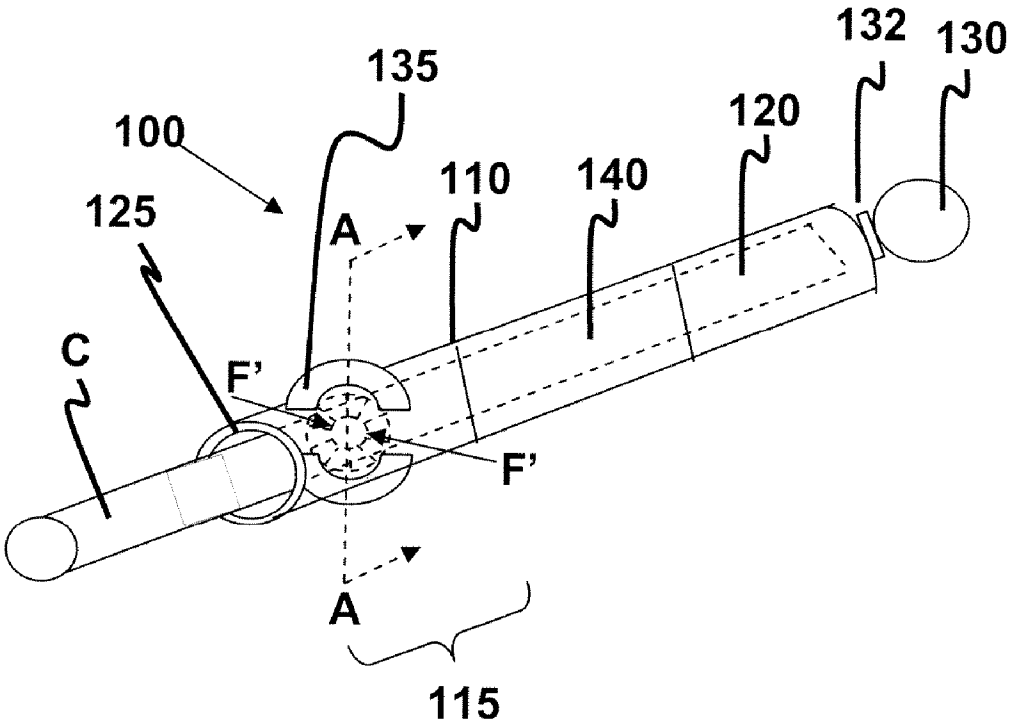
FIG. 1 is a perspective view of an embodiment of a container 100 with a cigarette or cigar C.

FIG. 1 is a perspective view of one embodiment of a container 100 holding a cigarette C. The container 100 may be configured to hold a standard size cigarette, a one-hundred size cigarette, a cigar, or the like. In the illustrated embodiment, the container 100 includes a body 110, a mouthpiece section 115 and an end section 120. In the illustrated embodiment, the body 110 is in the shape of a cylinder with about a ½" diameter and about a 2-½" length. In another embodiment (not shown), the body 110 has about a 3-½" length. In the illustrated embodiment, the mouthpiece section 115 is about ¾" long and the end section 120 is about 1" long, so a grip (discussed below) takes up the remaining length of ¾". A standard size cigarette C measures about ¼" in diameter and about 3" in length, including about a 1-¼" long mouthpiece or filter. A one-hundred size cigarette is similar, except it is about 4" in total length. In other embodiments (not shown), the container 100 can be configured to hold different sizes of smoking products, including, but not limited to, standard cigarettes, one-hundred size cigarettes, cigars of varied diameters and lengths, and the like. For example, cigars come in various lengths and diameters including, but not limited to, Robustos that measure about 4-½" long and Presidentes that measure about 8-½" long.

In the illustrated embodiment, the mouthpiece section 115 includes an opening 125 with external threads (not shown) that fasten the container 100 to a disposal receptacle (discussed below). In other embodiments (not shown), the opening 125 of the mouthpiece section 115 or connection surface includes at least one of the following types of fastening surfaces to allow connection to the disposal receptacle, including: internal or external threads, a snap fit, an interference fit, a tapered shape, and the like.

In the illustrated embodiment, a cap 130 is attached to the end section 120 by a hinge 132 and can be opened to permit a person to insert the cigarette C, cigar and the like into the end section 120 and then into the body 110 of the container 100. The person closes the cap, presses bottom of cap 130 to ignite the cigarette C, cigar and the like and the container is used to contain the ash, mouthpiece or filter, and the like within the body 110 during smoking. The cap 130 prevents ash from falling out of the container 100.

In the illustrated embodiment, the body 110, the mouthpiece section 115, and the end section 120, are made from non-flammable hard plastic materials with several openings to allow air flow (not shown) and are lined with a filter (not shown) to minimize or eliminate smoke emission from the container 100. The cap 130 is a smooth top surface (similar to a stove burner) and contains the mechanical and electrical components (including and at least one battery, for example a watch like battery) to ignite a cigarette when the cap is in the closed position and the cap button is manually held in. The cap is made from at least one of the following materials: steel, aluminum, metal alloy, plastic, carbon compounds and the like. In alternative embodiments (not shown), the body 110, the mouthpiece section 115, the end section 120, and the cap 130 are made from at least one of the following materials: steel, aluminum, metal alloy, plastic, carbon compounds, and the like. In another alternative embodiment (not shown), an insulating material coats the body 110, the mouthpiece section 115, the end section 120, and the cap 130 to prevent heat generated from the burning cigarette from reaching these surfaces.

In the illustrated embodiment, the container 100 includes a secure and release device 135 that is a metal tension pin configured to provide an opening for the cigarette C. A person opens the secure and release device 135 by applying a force F to its perimeter. The secure and release device 135 holds the cigarette C inside the container 100 in a stationary position.

Figure 3C:
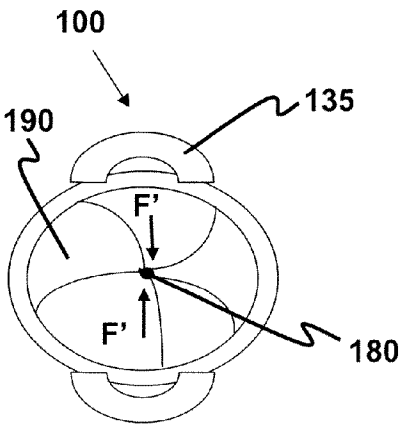
FIGS. 3A-C are cross sections of the secure and release device 135 of the container 100 along the line A-A of FIG. 1.
Figure 3B:
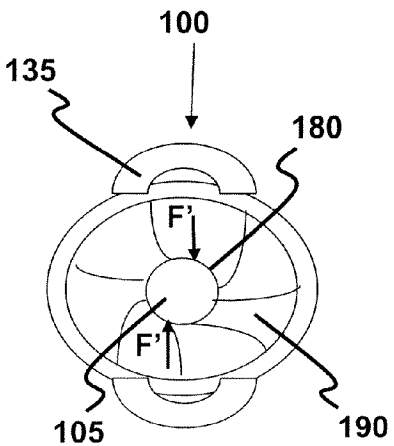
Figure 3A:
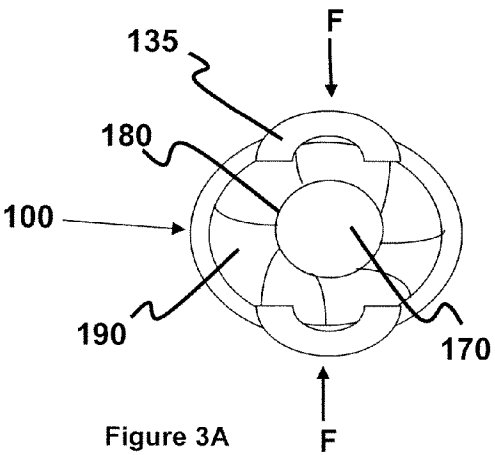

In the illustrated embodiment, the secure and release device 135 includes an expandable and contractible device (shown in FIGS. 3A-C as item 190). The expandable and contractible device 190 provides a force F' against an outer perimeter section of the cigarette C, close to the cigarette's mouthpiece or filter, to hold the cigarette C in place while the secure and release device 135 is in an open position. In other embodiments (not shown), the secure and release device 135 may be in the form of at least one of the following: a spring loaded mechanism, a clip, an adjustable slip collar, and the like.

The presence of the cigarette C biases the expandable and contractible device 190 to an open position. As a person burns a cigarette C, it burns and turns into ash. When the cigarette C burns past the location of the expandable and contractible device 190 the secure and release device 135 moves to a closed position, trapping the ash within the container 100. The cigarette remains can be pushed and extinguished against the closed secure and release device 135. After the cigarette remains are distinguished, the secure and release device 135 can be opened to dispose the used filter and remaining cigarette into the body 110 and then closed to store the ash and remaining cigarette.

In the illustrated embodiment, the container 100 includes a grip 140. The grip 140 is about ¾" in length and fits along the perimeter of the container 100, about 1" from the open end of the mouthpiece section 115. The grip 140 is made of a rubber material that is soft to the touch, but also serves as another barrier of insulation to prevent the heat from the burning cigarette to transfer to the outer surface of the container 100. In other embodiments (not shown), the grip 140 is shorter or longer than about ¾" and is made from at least one of the following materials: rubber, plastic, steel, plastic covered paper, metal alloys, gold, silver, stainless steel, plastic covered Styrofoam, and the like. In another embodiment (not shown), the container does not include a grip.

Figure 2B:
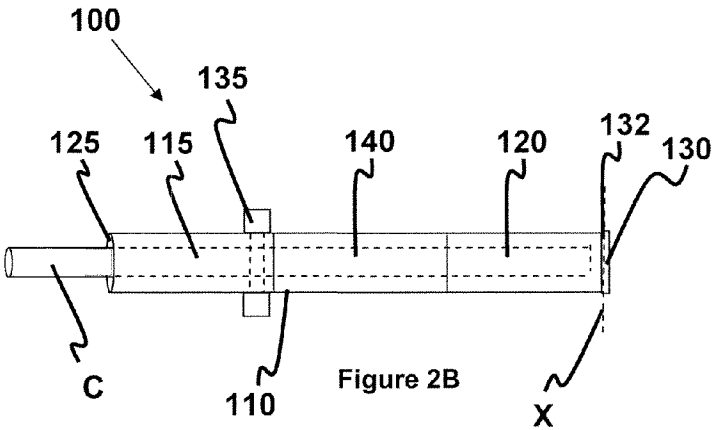
FIGS. 2A-2B are side views of the container 100 of FIG. 1.
Figure 2A:
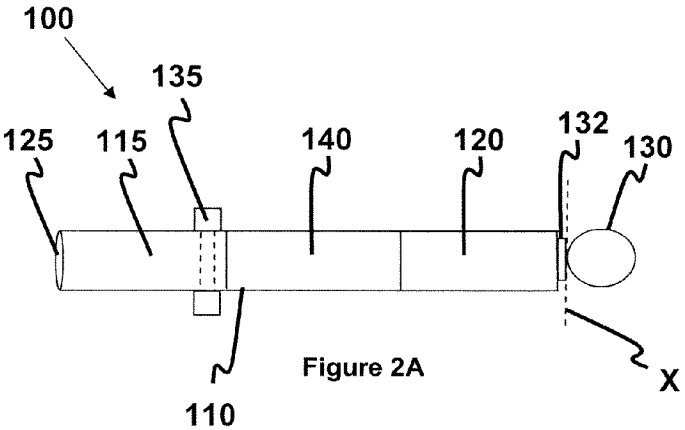

FIGS. 2A and 2B are side views of the illustrated embodiment of FIG. 1. FIG. 2A illustrates a side view of the container 100 without the cigarette C. Here the cap 130 is in an open position that allows placement of the cigarette C inside the container 100. FIG. 2B illustrates a side view of the container 100 holding a cigarette C. Here the cap 130 is in a closed position after placement of the cigarette C in the container 100. In the illustrated embodiments, the cap 130 pivots about an axis X or a hinge 132 to seal the end section 120. In other embodiments (not shown), the cap 130 seals the end section 120 by at least one at least one of the following: metal hinge device, sliding cap, cap with connecting chain, cap with interference fit or tapered fit, and the like.

FIGS. 3A-3C are cross-sections of the container 100 and the secure and release device 135 along the line A-A of FIG. 1. FIG. 3A illustrates force F applied to both sides of the secure and release device 135, resulting in the secure and release device 135 forming an opening 170 so a person can insert the cigarette C into the container 100. FIG. 3B illustrates the secure and release device 135 engaging the cigarette C. In the illustrated embodiment, a contact surface 180 is circular and applies an inward force F' to hold the cigarette C against the cigarette C. The contact surface 180 may be made of a non-flammable plastic material, steel, stainless steel, copper, ceramic, and the like. In other embodiments (not shown), the contact surface 180 can form an oval, square, rectangle, or any geometric shape while it is in its engaging position.

FIG. 3C illustrates a closed position of the secure and release device 135 when there is no force F applied and the cigarette C has been removed or burned and turned into ash 175 (not shown). In the illustrated embodiment, the contact surface 180 of an expandable and contractible device 190 applies an inward force F' to move the secure and release device 135 into a closed position. The position illustrated in FIG. 3C encloses the ash between the secure and release device 135 and the cap 130 until disposal and provides a surface that can be used to extinguish the remaining burning cigarette before it self-extinguishes. The expandable and contractible device 190 includes a plurality of springs (not shown) around its circumference that provide a bias or inward force F' towards a closed position. The expandable and contractible device 190 may be made of a non-flammable plastic material, steel, copper, and the like.

Figure 4:
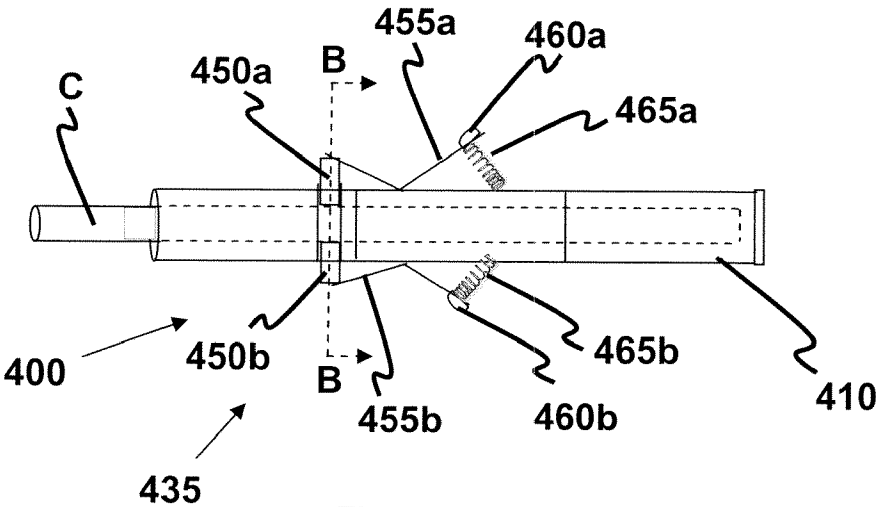
FIG. 4 is a side view of another embodiment of a container 400.

FIG. 4 is a partial side view of an alternative embodiment of a container 400 having a body 410. The container 400 is substantially the same as container 100, except for a secure and release device 435 having a spring loaded toggle clip that provides a force around the perimeter of a cigarette C. In the illustrated embodiment, the secure and release device 435 includes contact surfaces 450*a-b* connected to v-shaped rocker assemblies 455*a-b* that include finger plates 460*a-b* opposed by partially compressed springs 465*a-b* that are connected to the body 410. If the finger plates 460*a-b* opposed by partially compressed springs 465*a-b* are squeezed together, then the contact surfaces 450*a-b* release the cigarette. Alternatively, if the finger plates 460*a-b*, opposed by partially compressed springs 465*a-b*, are released or not squeezed together, then the contact surfaces 450*a-b* move radially inward and engage the cigarette contained within the container 400. If there is no cigarette C or it burns and turns into ash, then the contact surfaces 450*a-b* move inward toward each other until they touch to enclose the ash inside the container 400.

Figure 5B:
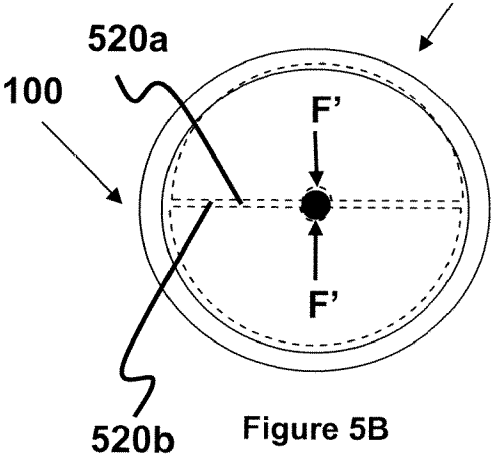
FIGS. 5A-B are cross sections of the secure and release device 510 of the container 400 along the line B-B of FIG. 4.
Figure 5A:
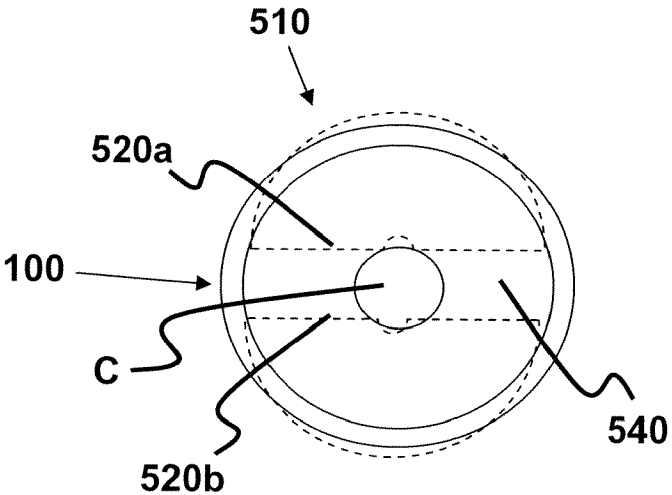

FIGS. 5A and 5B are cross-sections of the container 400 and an alternative embodiment of a secure and release device 510 along the line B-B of FIG. 4. FIG. 5A illustrates the position of the contact surfaces 520*a-b* when a force is applied to the finger plates 530*a-b* (not shown) and the formation of an opening 540 that allows placement of a cigarette C into the body 110 of the container 100. The contact surfaces 520*a-b* move vertically, contact surface 520*a* moves vertically up and contact surface 520*b* moves vertically down when force is applied to the finger plates 530*a-b* (not shown). In the illustrated embodiment, the opening 170 also remains when the force F is removed and the cigarette C opposes the finger plates 530*a-b* closure. In the illustrated embodiment, the contact surfaces 520*a-b* are in the shape of half circles. In other embodiments (not shown), the contact surfaces 520*a-b* form a shape similar to the cross section of the container 100.

FIG. 5B illustrates the closed position of the secure and release device 510 when there is no force applied to the finger plates 530*a-b* (not shown) or when the cigarette C has been removed or turned into ash. The closed position illustrated in FIG. 5B encloses the ash until disposal and provides a surface that can be used to extinguish the remaining burning cigarette before it self-extinguishes. In other embodiments (not shown), the secure and release device 510 can come in the form of other mechanical devices that can hold a cigarette and the like in place without causing damage to the cigarette and then provide a closing feature once the cigarette burns and turns into ash.

Figure 6A:
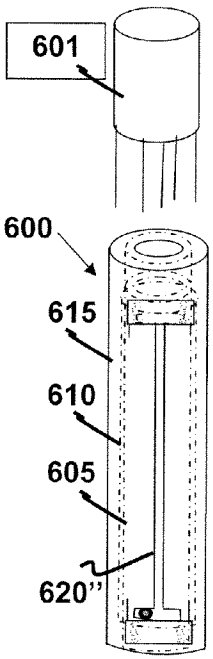
FIGS. 6A-D are perspective views of another embodiment of a container 600 and related components.

FIG. 6A illustrates a perspective view of an alternative embodiment of a container 600. The container 600 is similar to the container 100, except for a reuseable filter 601 to be used when loading non-filtered cigarettes, an inner tube 605, a filter 610, an outer tube 615, and other related components discussed further below. The inner tube 605, the filter 610, and the outer tube 615 each include a cutout consisting of a channel and top and bottom slits (discussed further below). In the illustrated embodiment, the filter 610 fits around the circumference of the inner tube 605 so a cutout 620 of the inner tube 605 is aligned with a cutout 620' of the filter. Further, the outer tube 615 fits around the circumference of the filter 610 and the inner tube 605 assembly, and a cutout 620" of the outer tube 615 is aligned with the cutout 620 of the inner tube 605 and the cutout 620' of the filter 620'.

In the illustrated embodiment, the inner tube 605, the filter 610, and the outer tube 615 are cylindrical. In other embodiments (not shown), the inner tube 605, the filter 610, or the outer tube 615 are any geometric shape.

Figure 6B:
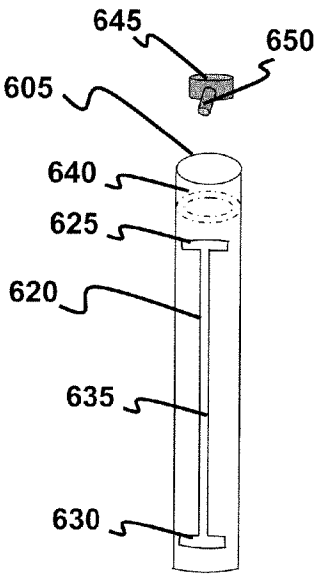

FIG. 6B illustrates a perspective view of the inner tube 605. In the illustrated embodiment, the inner tube 605 is made from steel. In other embodiments (not shown), the inner tube 605 is made from at least one of the following materials: stainless steel, copper, metal alloys, non-flammable plastic, carbon, and the like.

In the illustrated embodiment, the inner tube 605 includes the cutout 620 that further includes an upper slit 625, a lower slit 630, and a channel 635. The cutout 620 allows air to enter and permits smoke to exit the container 600. The cutout 620 must be formed to prevent ash from a cigarette C from falling out of the container 600. Further, the inner tube 605 includes a guide 640 that guides the cigarette C or the like into the container 600. The guide 640 is made from at least one of the following materials: steel, stainless steel, metal alloys, non-flammable plastic, carbon, and the like.

In the illustrated embodiment, the inner tube 605 further includes a stopper 645 that includes a handle 650. The stopper 645 is made from at least one of the following materials: steel, stainless steel, copper, metal alloys, non-flammable plastic, carbon, and the like. In the illustrated embodiment, the stopper 645 is configured to fit inside the inner tube 605. In another embodiment (not shown), the stopper 645 includes a spring loaded device that provides a one touch open or close feature that permits passage of a cigarette past the stopper 645. In yet another embodiment (not shown), the stopper 645 includes a mechanical or an electrical device that provides a one touch open or close feature and the mechanics to ignite a cigar, cigarette and the like. In yet another embodiment (not shown), the stopper 645 includes a mechanical or an electrical device that provides a one touch open or close feature and the mechanical and electrical device to ignite a cigar, cigarette and the like.

In the illustrated embodiment, the cylindrical handle 650 is connected to the stopper 645 and is configured to fit in the openings created by the cutout 620, including the upper slit 625, the lower slit 630, and the channel 635. As discussed below, the handle 650 is configured to fit in the cutout 620' of the filter 610 and the cutout 620" of the outer tube 615. Further, in the illustrated embodiment, the handle is made from non-flammable plastic, carbon, or other heat resistant material.

Figure 6C:
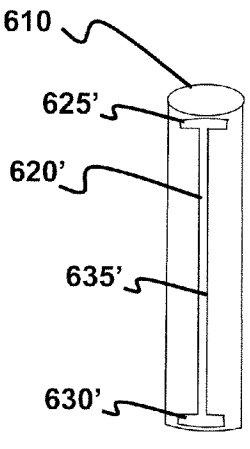

FIG. 6C illustrates a perspective view of the filter 610. In the illustrated embodiment, the filter 610 includes the cutout 620' that further includes an upper slit 625', a lower slit 630', and a channel 635'. In the illustrated embodiment, the filter 610 is made from a porous carbon material that removes injurious components from smoke.

In other embodiments (not shown), the filter 610 is made from at least one of the following materials: synthetic micas, HEPA filter material, fiber aggregates, activated carbon, and the like. In yet other embodiments (not shown), the filter 610 is made from a flexible material that eliminates the opening formed by the cutout 620' when the handle 650 is not in a portion of the cutout 620' and creates an opening about the size of the handle 650 when the handle 650 is in some portion of the cutout 620'. The flexible filter material prevents ash from coming out of the cutout 620' and filters smoke emissions.

In the illustrated embodiment, the filter 610 is configured to have an inside diameter that fits over the inner tube 605 and an outside diameter that fits inside the outer tube 615. Further, the filter 610 is illustrated as shorter in length then the inner tube 605. In other embodiments (not shown), the filter 610 is the same length as the inner tube 605 or is greater in length than the inner tube 605.

Figure 6D:
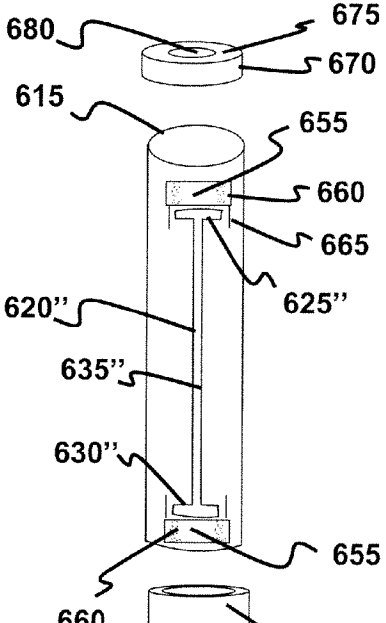

FIG. 6D illustrates a perspective view of the outer tube 615. In the illustrated embodiment, the outer tube 615 is made from steel. In other embodiments (not shown), the outer tube 615 is made from at least one of the following materials: stainless steel, copper, metal alloys, non-flammable plastic, carbon, and the like.

In the illustrated embodiment, the outer tube 615 includes the cutout 620" that further includes an upper slit 625", a lower slit 630", and a channel 635". The cutout 620" is configured to prevent ash from falling out the container 600, e.g., the cutout 620" may include a rubber flashing (not shown) that allows passage of the handle 650 or the stopper 645, but not cigarette ash. In the illustrated embodiment, the outer tube 615 is configured to allow the inner tube 605 and the filter 610 assembly to be inserted inside it. In other embodiments (not shown), the outer tube 615 is configured to only allow the inner tube 605 or the filter 610.

In the illustrated embodiment, the outer tube 615 includes two sliding collars 655. Each sliding collar 655 includes at least one spring 660 that provides a force that keeps the sliding collar 655 in a position over the upper slit 625" or the lower slit 630" of the outer tube 615. The sliding collars 655 seal the upper slit 625" and the lower slit 630" to prevent ash from coming out of the container 600. In the illustrated embodiment, the outer tube 615 further includes guide tracks 665. The guide tracks 665 allow the sliding collars 655 to be moved away from the upper slit 625" or the lower slit 630" along the circumference of the outer tube 615, then the stopper 645 can be locked into position in the upper slit 625" or lower slit 630". Further, as discussed above, the guide tracks 665 allow the lower sliding collar 655 to be moved away from the lower slit 630" so the stopper 645 can be opened or closed with the one touch feature.

FIG. 6D further illustrates a perspective view of an upper cap 670 that includes a rubber element 675 with an opening 680, and further illustrates a perspective view of a lower cap 685. In the illustrated embodiment, the rubber element 675 and the opening 680 are configured to be smaller than the diameter of a cigarette C or the like, so the rubber element 675 slightly engages the cigarette C as the cigarette C is inserted or adjusted in the container 600. Further, the rubber element 675 provides a seal to prevent ash from coming out of the container 600 when there is not a cigarette C inserted in the container 600. In other embodiments (not shown), the rubber element 675 further includes a collapsible flap (not shown) that creates a seal in the opening 680 when the cigarette C is removed from the container 600.

Figure 6E:
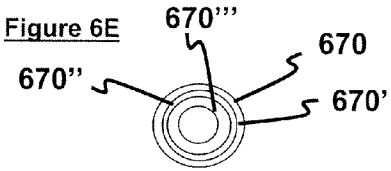
FIG. 6E is a top view of an upper cap 665.

FIG. 6E illustrates a top view of the upper cap 670 that includes an outer slot 670', a middle slot 670", and an inner slot 670'". The upper cap 670 is made from at least one of the following materials: steel, stainless steel, copper, metal alloys, non-flammable plastic, carbon, and the like.

In the illustrated embodiment, the outer slot 670' is configured to hold together the container 600 by engaging the upper end of the outer tube 615. The upper end of the outer tube 615 is engaged by an interference fit provided by the outer slot 670' of the upper cap 670. Further, the middle slot 670" is configured to engage the upper end of the filter 610 and the inner slot 670'" engages the inner tube 605, both by interference fits. In other embodiments (not shown), other structural designs can be used in the upper cap 670 to provide support for the outer tube 615, the filter 610, and the inner tube 605, including at least one of the following: clips, slots, fasteners, and the like.

Figure 6F:
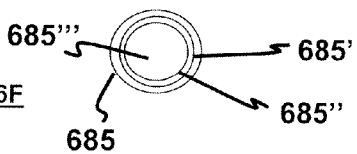
FIG. 6F is a top view of a lower cap 680.

FIG. 6F illustrates a top view of the lower cap 685 that is substantially similar to the inner structure of the upper cap 670, including an outer slot 685', a middle slot 685", and a inner slot 685'". In the illustrated embodiment, the outer slot 685' is configured to engage the lower end of the outer tube 615 by an interference fit between the two surfaces. Further, the middle slot 685" is configured to engage the lower end of the filter 610 and the inner slot 685'" is configured to engage the lower end of the inner tube 605. In other embodiments (not shown), the lower cap 685 further includes a hinged circular structure or door that allows the container 600 to be attached to a disposal receptacle (discussed below) to remove ash and the like from the container 600 without disassembling the lower cap 685 from the container 600.

Figures 7A, 7B, 7C, 7D:
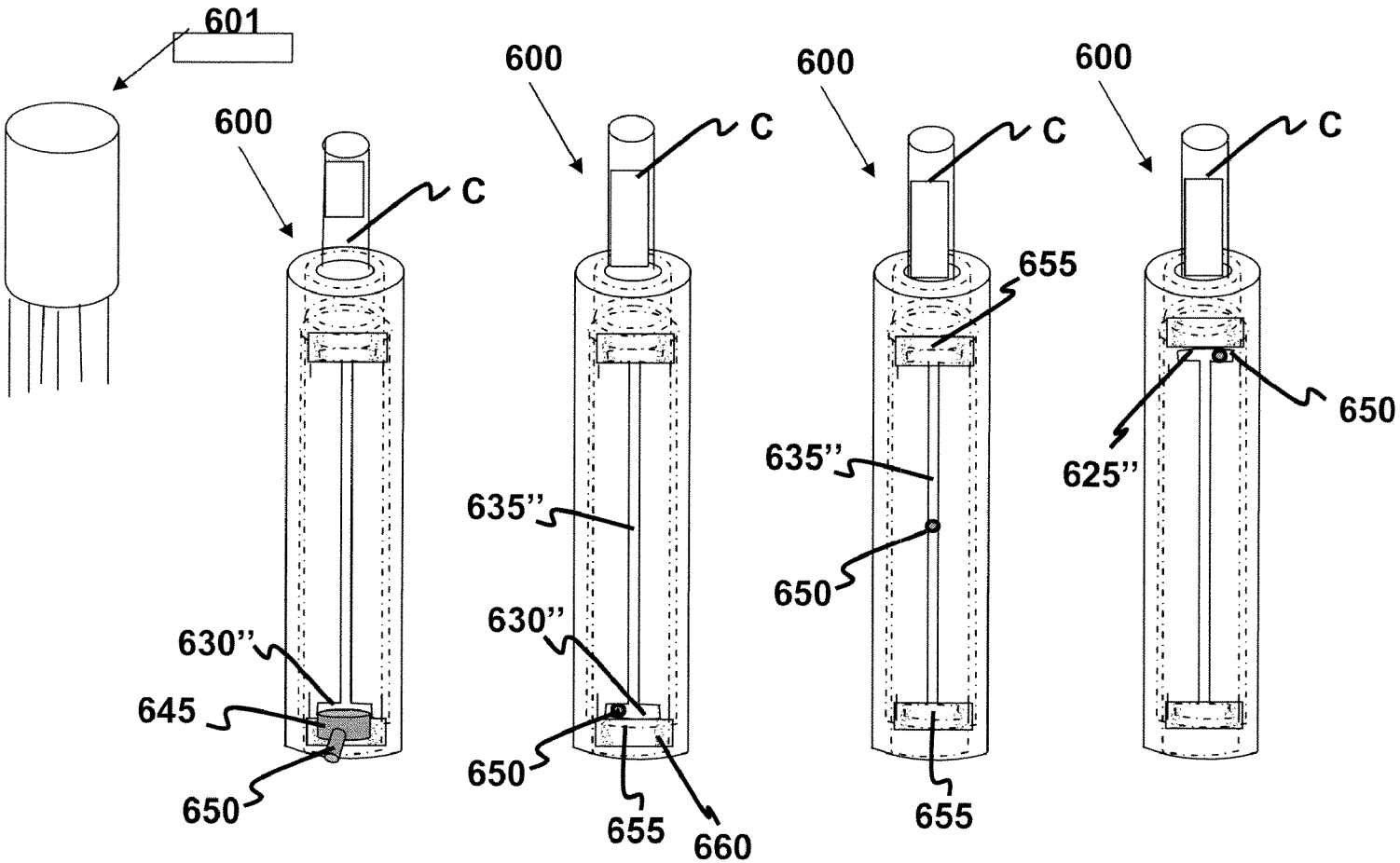
FIGS. 7A-D are perspective views of the container 600 showing how the container 600 is used with a cigarette C.

FIGS. 7A-D illustrate use of the container 600 with a cigarette C. FIG. 7A illustrates the container 600 with the stopper 645 and the handle 650 assembly in an open position of the lower slit 630" that provides a clear opening in the inside tube 605. In the illustrated embodiment, the clear opening in the inside tube 605 allows the cigarette C to be inserted into the container 600 and ignited by a match or the like. The reuseable filter 601 is used when loading non-filtered cigarettes.

FIG. 7B illustrates the container 600 holding the cigarette C and the stopper 645 and the handle 650 assembly moved into a closed position in the lower slit 630" when the cigarette C is to be smoked. In this position, the stopper contains ash (not shown) inside the inner tube 605 while the cigarette C is smoked.

In the illustrated embodiment, the stopper 645 and the handle 650 assembly are held in place by spring force provided by the springs 660 of the sliding collar 655. In another embodiment (not shown), the stopper 645 and the handle 650 are held in place by the spring force provided by the springs 660 of the sliding collar 655 on either side of the channel 635". In yet other embodiments (not shown), a mechanical device known by one skilled in the art holds the stopper 645 and the handle 650 assembly in the closed position.

FIG. 7C illustrates the position of the stopper 645 and the handle 650 assembly and the sliding collars 655 when the stopper 645 and the handle 650 assembly is moved between the lower slit 630" and the upper slit 625". In the illustrated embodiment, the two sliding collars 655 seal the lower slit 630" and the upper slit 625" so ash is contained in the inner tube 605.

FIG. 7D illustrates the position of the stopper 645 and the handle 650 assembly and the upper sliding collar 655 when the stopper 645 and the handle 650 assembly are in a closed position in the upper slit 625". In the illustrated embodiment, the stopper pushes ash that was inside the inner tube 605 into its upper portion and then the cigarette C is pushed against the stopper 645 to extinguish any remaining burning tobacco. After the stopper 645 extinguishes the remaining cigarette C, the stopper 645 and the handle 650 assembly are moved into the open position, as shown in FIG. 7A above, so the ash and the like can be disposed as discussed below.

Figure 8:
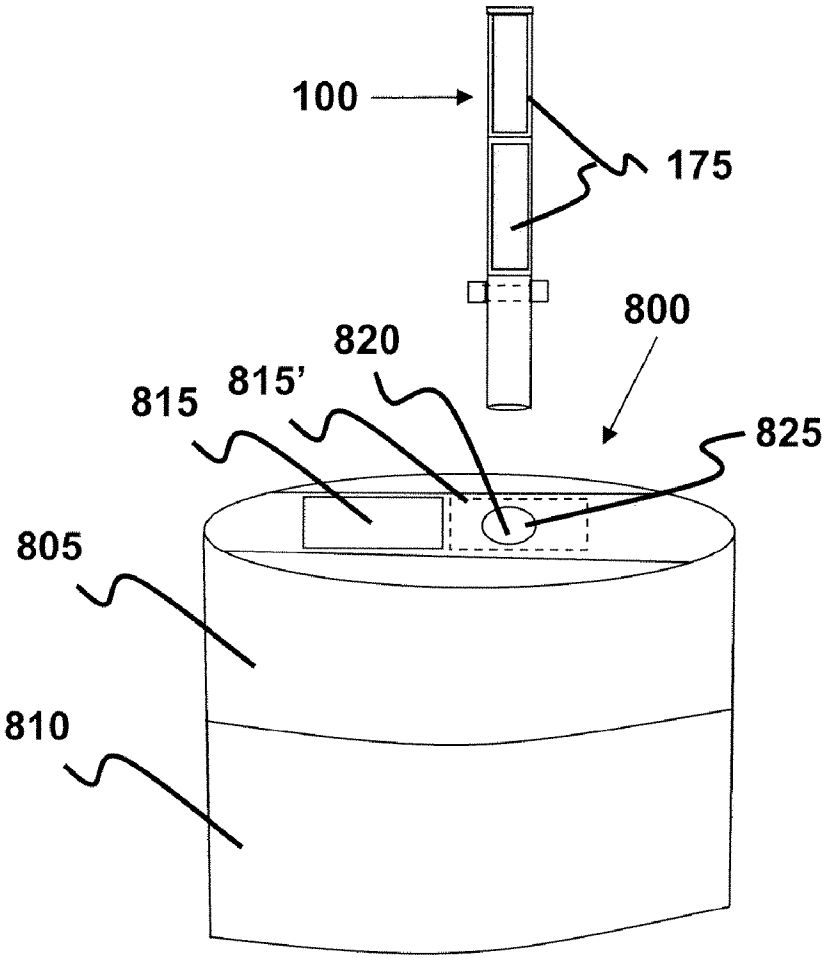
FIG. 8 is a perspective view of one embodiment of a disposal receptacle 800 with the container 100 of FIG. 1.

FIG. 8 is a perspective view of a disposal receptacle 800 showing exemplary container 100 aligned and filled with ash 175. In the illustrated embodiment, a portable, personal size disposal receptacle 800 includes a lid 805 connected to a lower barrel 810. The lid 805 and the lower barrel 810 may be connected by at least one of the following: threaded connection, interference fit, interference fit with rubber seal, snap fit, hinged connection, tongue and groove, and the like. In an alternative embodiment, the lid 805 simply rests on top of the receptacle 800. In the illustrated embodiment, the lid 805 includes a plate 815 that is about 1½" long and slides from side to side (e.g. as illustrated with dash line plate 815') along the lid 805 to cover or expose an opening 820.

In the illustrated embodiment, the opening 820 in the lid 805 has ½" internal diameter threads 825, so external threads 125 of the mouthpiece section 115 of the container 100, illustrated in FIG. 1, can connect to the disposal receptacle 800. In other embodiments (not shown), the opening 820 has a structure configured to connect to the mouthpiece section 115, including at least one of the following connections: a snap fit, interference fit, hinged connection, tongue and groove, and the like. In yet other embodiments (not shown), the opening 820 includes a funnel to collect and direct the ash and the like to the bottom of the lower barrel 810. In other embodiments (not shown), the opening 820 includes a spring loaded closure device that the containers 100, 400, or 600 can be inserted into for disposal of ash and the like.

In the illustrated embodiment, the disposal receptacle 800 is cylindrical in shape with a height of about 2 inches and a diameter of about 2 inches at each end. The lid 805 is about 1 inch in height and the lower barrel 810 is about 1 inch in height. It should be understood that the disposal receptacle 800 and lid 805 may have any desired dimensions. In other embodiments (not shown), the disposal receptacle 800 has a cross section that is of at least one of the following shapes: square, oval, circle, rectangle, diamond, octagon, pentagon, and any geometric shape.

In the illustrated embodiment, the disposal receptacle 800, including the lid 805, the lower barrel 810, and the plate 815, is made from non-flammable, polymeric material. In other embodiments (not shown), the disposable receptacle 800 is made of steel, stainless steel, metal alloys, non-flammable hard rubber, carbon fiber, shatterproof glass, and the like.

Figure 9:
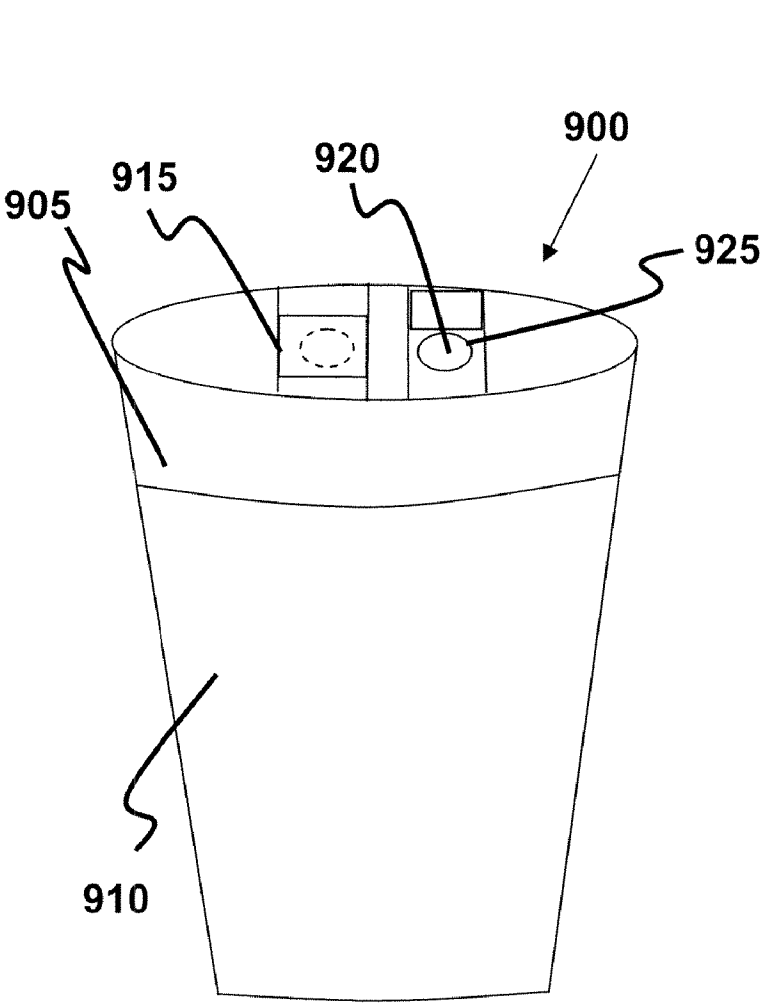
FIG. 9 is a perspective view of an alternative embodiment of a disposal receptacle 900.

FIG. 9 illustrates another embodiment of a disposal receptacle 900 for car or home use that fits into a standard size cup holder and the like (e.g. the lower barrel has a flat bottom and has a diameter that is about 2 inches). In the illustrated embodiment, the disposal receptacle 900 is substantially similar to the disposal receptacle 800 illustrated in FIG. 8, except a lower barrel 910 is 6 inches in height and has a diameter that varies from about 2 inches at the bottom to about 3-½ inches at the top of the lower barrel 910. In addition, a lid 905 is about 3-½ inches in diameter and has at least one plate 915 that is about 1-½ inches long that slides from side to side to cover or expose an opening 920. In other embodiments (not shown), the lid 905 may include more than one opening 920 and corresponding plate 915. It should be understood that the disposal receptacle 900 and the lid 905 may have any desired dimensions. In other embodiments (not shown), the lid 905 further includes an extended sidewall that contains any ash or debris that may be produced from connecting containers 100, 400, or 600 onto the disposal receptacle 900.

Figures 10A, 10B, 10C:
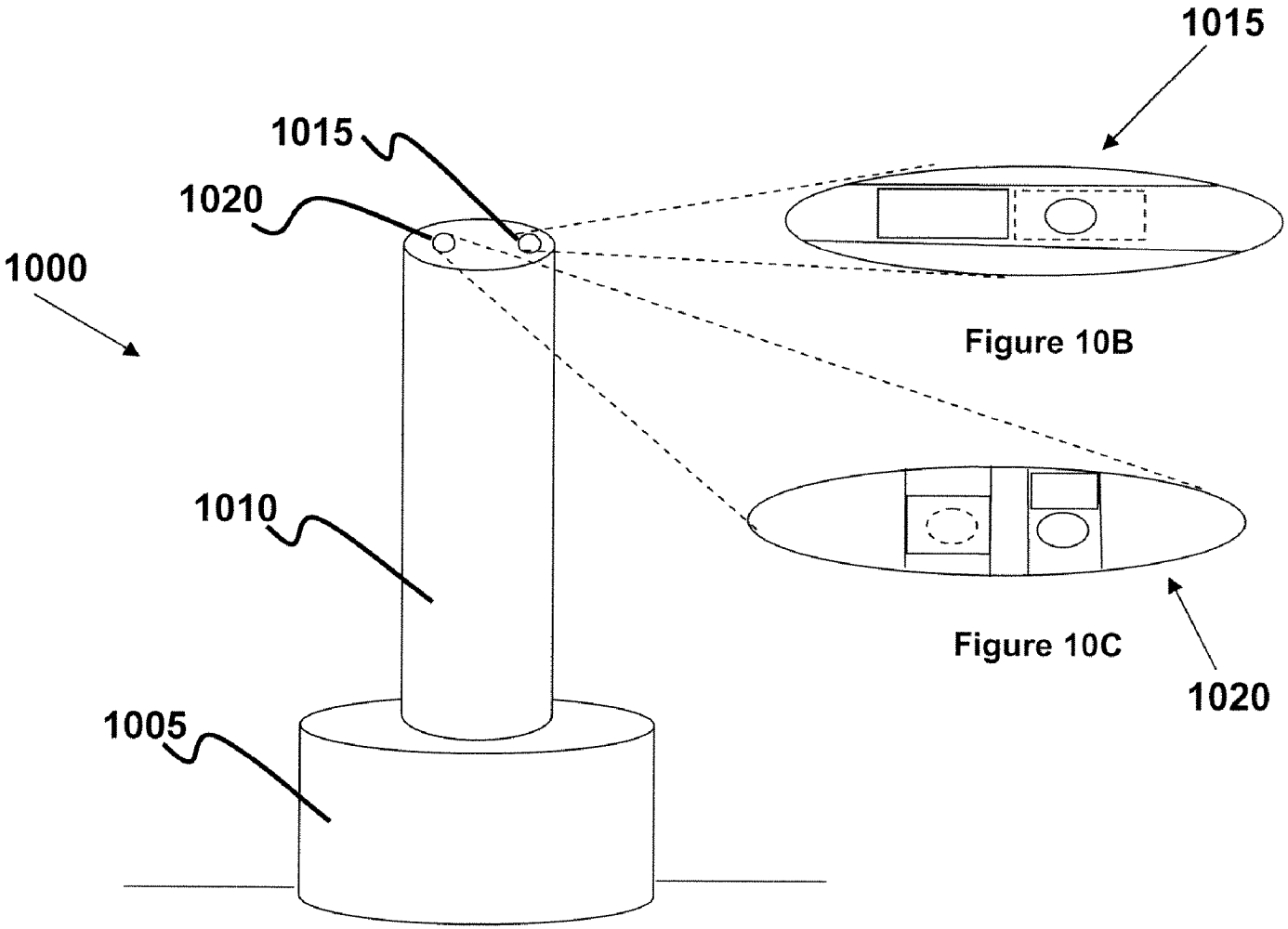
FIG. 10A is a perspective view of another alternative embodiment of disposal receptacle 1000.
FIGS. 10B-10C are close up views of the plate and opening sections of the disposal receptacle 1000.

FIG. 10A illustrates another embodiment of a disposal receptacle 1000 for use in public areas, including outside buildings or in public smoking areas and the like. In the illustrated embodiment, the disposal receptacle 1000 has a lower base 1005 and an upper disposal section 1010 made from non-flammable, polymeric material. In other embodiments (not shown), the lower base 1005 and the upper disposal section 1010 is made of steel, stainless steel, metal alloys, non-flammable hard rubber, carbon fiber, shatterproof glass, and the like. The lower base 1005 and the upper disposal section 1010 are cylindrical in shape, but it should be understood that the disposal receptacle 1000 may have any desired shape. In the illustrated embodiment, the upper disposal section 1010 includes a plate and opening section 1015 on the top of the upper disposal section 1010. The plate and opening section 1015, exploded view shown in FIG. 10B, are substantially similar to the plate 815 and the opening 820 in FIG. 8. Further, in the illustrated embodiment, the top of the upper disposal section 1010 includes a plate and opening section 1020. The plate and opening section 1020, exploded view shown in FIG. 10C, are substantially similar to the plate 915 and the opening 920 in FIG. 9. In other embodiments (not shown), the plate 1015, the opening section 1020, or both, may be in various other locations of the disposal receptacle 1000.

Figure 11:
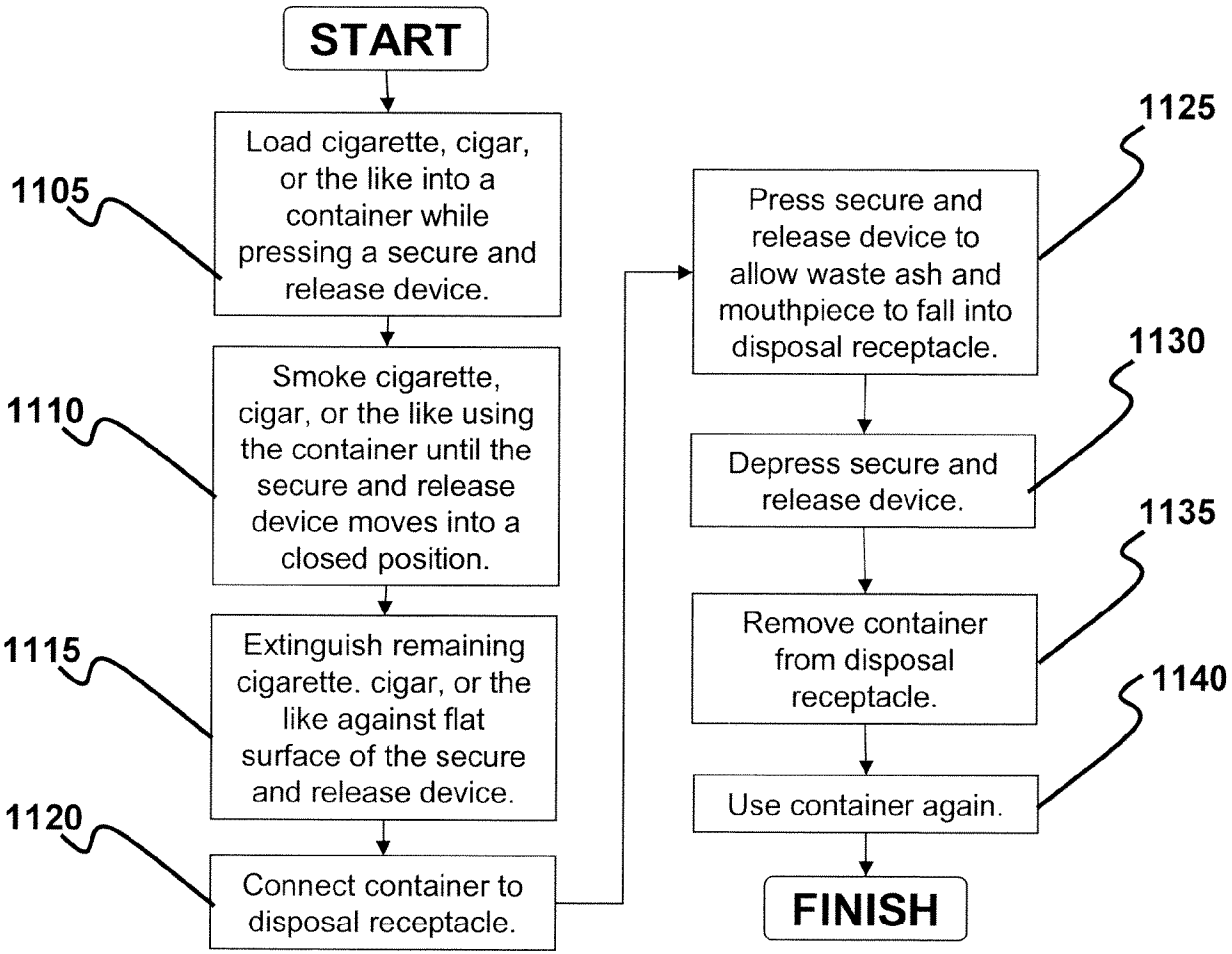
FIG. 11 is a flow chart for a method to use the container 100 with the disposal devices 800, 900, or 1000.

FIG. 11 illustrates a method and related steps for using containers 100, 400, or 600 (discussed above) with the disposal receptacle 800, 900, or 1000 of FIGS. 8-10, respectively. First, a person inserts a cigarette C, cigar, or the like into a container 100 while pressing the secure and release device 135 so it is in an open position at 1105. Second, the person smokes the cigarette C, or and the like using the container 100 until the secure and release device 135 moves into a closed position at 1110. Third, the remaining cigarette C, cigar and the like is distinguished against the flat surface of the secure and release device 135 in a closed position at 1115. Fourth, a user connects the external threads 125 of the container 100 to the internal threads of the opening of the disposal receptacle at 1120. Fifth, once the container 100 and the disposal receptacle are connected, then the user presses the secure and release device 135 and the waste ash 175 and mouthpiece fall into the disposal receptacle at 1125, then the user releases the secure and release device 135 back to the closed position at 1130. Sixth, the container 100 is removed from the disposal receptacle 800, 900, or 1000 at 1135 and the user can reuse container 100 at 1140.

Figure 12:
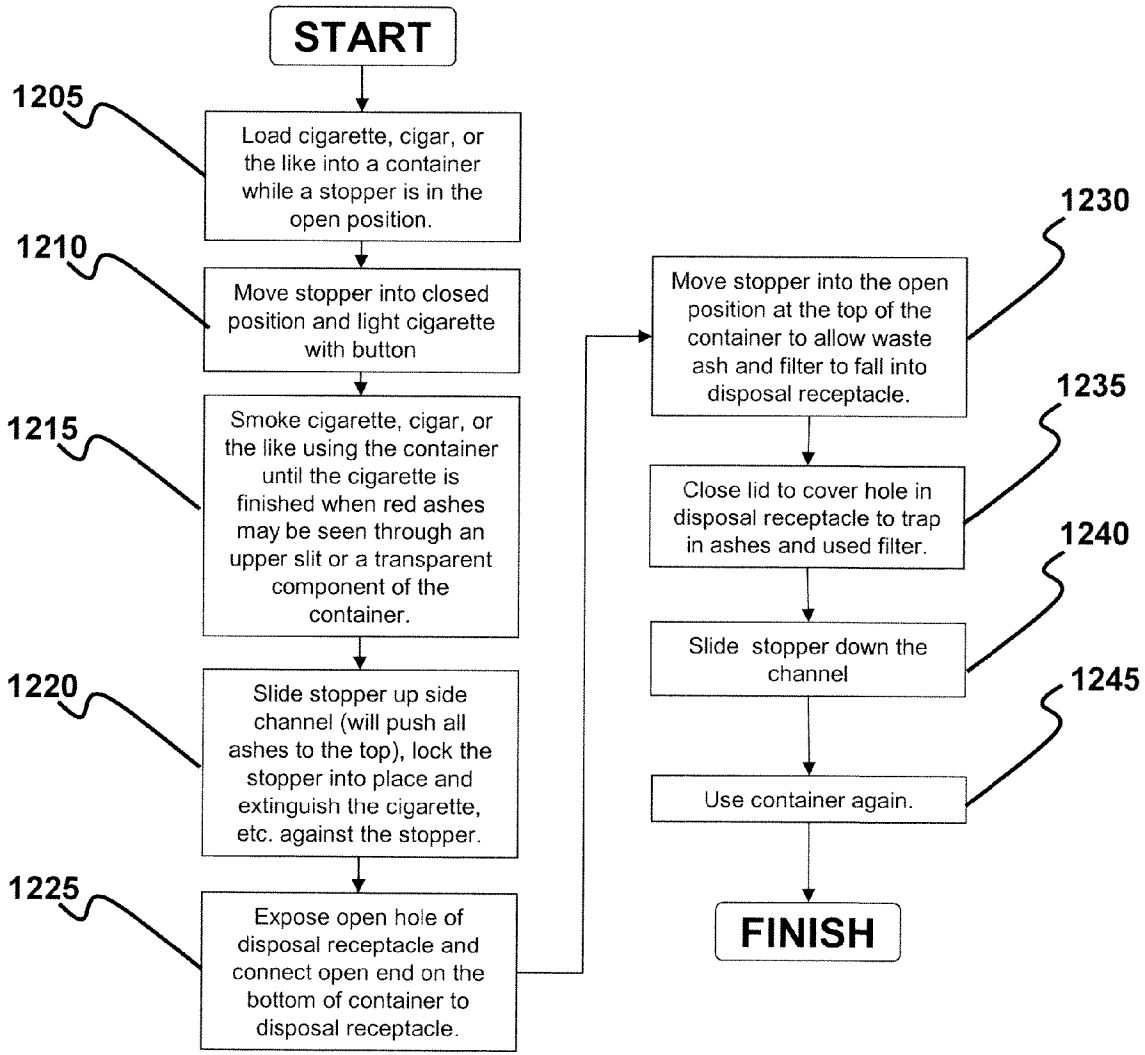
FIG. 12 is a flow chart for a method to use the container 600 with the disposal devices 800, 900, or 1000.

FIG. 12 illustrates a method for using the container 600 (discussed above) with the disposal receptacle 800, 900, or 1000 of FIGS. 8-10, respectively. A person inserts a cigarette C, cigar, or the like into a container 600 when the stopper 645 is in an open position at 1205. Further, a person closes the stopper and depresses bottom button to ignite the cigarette at 1210. A person smokes the cigarette C, or and the like using the container 600 until the cigarette is almost finished when red ashes may be seen through the upper slit 625 at 1215. Then a person slides the stopper 645 up the channel 635 to push the ashes to the top, locks the stopper 645 and then extinguishes the cigarette against the stopper 645 at 1220. A person exposes the open hole of the disposal receptacle 800, 900, or 1000 and connects the bottom of container 600 to the disposal receptacle at 1225. Then a person moves the stopper 645 into the open position at the top of the container 600 that allows the waste inside the container 600 to fall into the disposal receptacle at 1230. A person closes the open hole of the disposal receptacle 800, 900, or 1000 to trap the waste (ashes and the used filter) at 1235. Then a person slides the stopper 645 down the channel 635 in an open position to allow the person to insert another cigarette at 1240 so the person can reuse the container 600 again at 1245.

While the apparatus, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on provided herein. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the claims (e.g., A or B) it is intended to mean "A or B or both". When the applicants intend to indicate "only A or B but not both" then the term "only A or B but not both" will be employed. Similarly, when the applicants intend to indicate "one and only one" of A, B, or C, the applicants will employ the phrase "one and only one". Thus, use of the term "or" herein is the inclusive, and not the exclusive use.

What is claimed is:

1. A container comprising:

an outer tube;

a first opening disposed in a first end of the outer tube;

a second opening disposed in a second end of the outer tube; and an inner tube having a guide that is configured to guide a cigarette or a cigar as it is inserted into the container;

a filter configured to fit around the inner tube, wherein the outer tube is configured to fit around the filter;

a first cap configured to fit on the first end of the outer tube, a first end of the filter, and a first end of the inner tube, the first cap having a first opening;

a rubber element disposed on the first cap and configured to hold at least a portion of the cigarette or cigar, wherein the rubber element is configured to provide a seal when the cigarette or the cigar is not in contact with the rubber element;

a second cap having a connection surface, the second cap being configured to fit on the second end of the outer tube, a second end of the filter, and a second end of the inner tube;

a stopper; and a handle, wherein the outer tube, the filter, and the inner tube each include openings that are aligned with each other, and wherein the stopper is configured to move along an inner diameter of the inner tube and the handle is configured to move along the aligned openings in the outer tube, the filter, and the inner tube.

2. The container of claim 1, wherein the aligned openings in the outer tube, the filter, and the inner tube each include a channel, a first slit, and a second slit configured to prevent ash from falling out of the container.

3. The container of claim 2, wherein the channel, the first slit, and the second slit in each of the aligned openings are configured to allow movement of the stopper and the handle.

4. The container of claim 3, wherein the outer tube further comprises two sliding collars each having at least one spring and two guide tracks, wherein the sliding collars include a first sliding collar configured to seal the first slit and a second sliding collar configured to seal the second slit, and wherein the first sliding collar is configured to move along a first guide track to expose the first slit, allowing the stopper and the handle to be locked in the first slit, and wherein the second sliding collar is configured to move along a second guide track to expose the second slit, allowing the stopper and the handle to be locked in the first slit.

5. The container of claim 4, wherein the stopper and the handle are configured to push ashes inside the inner tube to an upper portion of the container, and the stopper and the handle are configured to extinguish the cigarette or the cigar.

6. The container of claim 1, further comprising an ignition device.

7. The container of claim 1, wherein the filter is made from at least one of the following materials: porous carbon material, synthetic micas, high efficiency particulate air filter material, fiber aggregates, and activated carbon.

* * * * *